US007762217B2

(12) United States Patent
Mariscal Muñoz

(10) Patent No.: US 7,762,217 B2
(45) Date of Patent: Jul. 27, 2010

(54) COMBINED-CYCLE COMBUSTION ENGINE BASED ON CONTRIBUTION OF CARBON DIOXIDE ($CO_2$) TO THE COMBUSTION GASES

(76) Inventor: Manuel Mariscal Muñoz, C/ San Asturio Serrano 1 - 3°C 28802 Alcalá de Henares, Madrid (ES)

( * ) Notice: Subject to any disclaimer, the term of this patent is extended or adjusted under 35 U.S.C. 154(b) by 972 days.

(21) Appl. No.: 11/029,851

(22) Filed: Jan. 5, 2005

(65) Prior Publication Data

US 2005/0193962 A1 Sep. 8, 2005

(30) Foreign Application Priority Data

Jan. 5, 2004 (ES) ..... 200400007

(51) Int. Cl.
*F02B 19/00* (2006.01)

(52) U.S. Cl. ..... 123/1 A

(58) Field of Classification Search ..... 123/26, 123/25 C, 1 A, 435, 198 A, 568.11–56, 1 R
See application file for complete search history.

(56) References Cited

U.S. PATENT DOCUMENTS

| | | | | |
|---|---|---|---|---|
| 2,747,560 | A * | 5/1956 | Rounds et al. | 123/577 |
| 4,446,821 | A * | 5/1984 | Cataldo | 123/26 |
| 4,589,377 | A * | 5/1986 | Van Dal | 123/25 C |
| 5,007,381 | A * | 4/1991 | Kakegawa et al. | 123/1 A |
| 5,125,366 | A * | 6/1992 | Hobbs | 123/25 C |
| 6,286,482 | B1 * | 9/2001 | Flynn et al. | 123/435 |
| 6,513,505 | B2 * | 2/2003 | Watanabe et al. | 123/525 |
| 7,171,924 | B2 * | 2/2007 | Robel et al. | 123/26 |

FOREIGN PATENT DOCUMENTS

| | | | |
|---|---|---|---|
| DE | 36 25 451 | A1 | 2/1988 |
| DE | 39 43 167 | A1 | 7/1991 |
| JP | 55091719 | | 11/1980 |
| JP | 08144897 | A * | 6/1996 |
| JP | 2000-8899 | | 1/2000 |
| JP | 2002180909 | A * | 6/2002 |

OTHER PUBLICATIONS

International Search Report dated Apr. 27, 2005, issued in corresponding International Application No. PCT/ES2004/000588.

* cited by examiner

*Primary Examiner*—M. McMahon
(74) *Attorney, Agent, or Firm*—Ostrolenk Faber LLP

(57) ABSTRACT

A conventional combustion engine, either gasoline or diesel model, with its corresponding engine block and cylinders is provided with complementary injectors for carbon dioxide ($CO_2$) coming from a liquefied gas supply deposit, such that said injectors supply the duly metered carbon dioxide ($CO_2$) to each cylinder after the piston has passed the top dead center, immediately after the ignition of the fuel has occurred, whereby part of the heat generated by this ignition is absorbed by the carbon dioxide ($CO_2$), which experiences a heavy expansion, with the resulting and parallel increase of the power of the engine. A thermal exchanger is arranged in the conduit supplying the carbon dioxide from the deposit to the cylinders, which exchanger is in turn arranged in the exhaust pipe of the engine so that the carbon dioxide ($CO_2$), at room temperature in the deposit, is pre-heated when it reaches the engine.

5 Claims, 2 Drawing Sheets

COMBINED-CYCLE COMBUSTION ENGINE BASED ON CONTRIBUTION OF CARBON DIOXIDE ($CO_2$) TO THE COMBUSTION GASES

OBJECT OF THE INVENTION

The present invention refers to a new combined-cycle combustion engine which, starting from the basic structure of a gasoline engine (Otto cycle) or a diesel engine (diesel cycle) aims its features at the fact that the thermodynamic cycle, by means of which both cases are controlled, is modified by the contribution of a gas, specifically carbon dioxide ($CO_2$) which, upon coming into contact with the hot combustion gases, experiences a strong thermal expansion, thus contributing to remarkably increasing the pressure inside the cylinder.

This obviously translates into an increase of the torque and, accordingly, an increase of the power of the engine.

Control of the engine can be carried out in two manners, one way is by controlling the entry of air and fuel which is burned inside the cylinders of the engine, as currently occurs in a conventional engine, and the other way is by metering or modifying the amount of carbon dioxide contributed to the cylinder.

Therefore, the object of the invention is to achieve a combined-cycle engine, for the thermodynamic point of view, in which the power released in combustion is better used with regard to its conversion into useful mechanical work, precisely due to the combination of two thermodynamically different cycles, but with the special particularity that, when the gases participating therein are mixed together, a lesser degree of mechanical complexity is achieved for the engine than that of combined-cycle engines in which the gases act without mixing.

The engine proposed by the intention is especially suitable for being used in the automotive field.

BACKGROUND OF THE INVENTION

Combined-cycle engines, based on the combination of two different thermodynamic cycles, are known, such as one of gas and one of steam, for example, which will result in a considerably lower final temperature of the combustion gases, i.e. at the end of the final thermodynamic process, which means that the thermal energy released to the environment has a lower temperature level.

However, these combined-cycle combustion engines are conceived to recover steam, such that the latter can be cooled and condensed in order to be reused, which implies an extraordinary mechanical complexity in the engine, requiring independent means for treating the gases, which not only has an affect on the costs, but which makes these combined-cycle engines inapplicable in the automotive field, for which the engine of the invention has basically been designed, both due to reasons of space and weight.

DESCRIPTION OF THE INVENTION

The combined-cycle engine proposed by the invention solves in a fully satisfactory manner the drawbacks set forth above.

To that end and more specifically, the proposed engine departs from a carbon dioxide ($CO_2$) power supply, consisting of a deposit of an appropriate capacity, in which said carbon dioxide ($CO_2$) can be in liquid or gaseous phase, according to the environmental conditions, said deposit being duly connected to the engine cylinders, which the carbon dioxide ($CO_2$) gains access to through injectors designed for that purpose, either with the same pressure as said gas in the deposit or under greater pressure with the cooperation of a suitable pump, the carbon dioxide ($CO_2$) being introduced in each cylinder immediately after the piston has passed the top dead center to prevent a pressure overload inside the cylinder and to furthermore give time for the combustion of the injected fuel, such as the gasoline or the diesel, for example, to occur such that when the carbon dioxide ($CO_2$) comes into contact with the combustion gases at a high temperature, said carbon dioxide ($CO_2$) is heated, causing an expansion thereof with the resulting increase of pressure inside the cylinder and, in turn, with the resulting increase of power in the expansion stroke.

According to another feature of the invention, it has been provided that the carbon dioxide ($CO_2$) is injected in the periphery of the cylinder, whereby a double effect is achieved; on one hand, not excessively interfering with the combustion gases, and on the other, and this is essential, establishing a thermal isolation barrier between the mass of hot gases inside the cylinder and the wall thereof, which prevents heat leaks and improves the performance of the engine. The turbulence inside the cylinder ensures at all times the gradual and progressive hearing of the carbon dioxide ($CO_2$) and the transfer of heat between the hot gases and the colder carbon dioxide ($CO_2$) gas which is injected inside the cylinders. This means that the increase of the pressure is gradual and not explosive, given that the objective sought after is to maintain the pressure inside the cylinder as uniformly as possible during the first section of the expansion stroke. At the end of said expansion stroke, the injected carbon dioxide ($CO_2$) is ejected outside of the engine with the rest of the combustion products.

The contribution of gas to the cylinders implies an increase of the power of the engine. This increase of power can be controlled by reducing the contribution of fuel for the purpose of not exceeding the maximum power demanded at all times. Whereby a more remarkable final reduction of engine fuel consumption can be achieved based on two reasons: one of them is because the mere contribution of gas ($CO_2$) to each one of the cylinders of the engine implies an increase of the pressure in them, and another reason is that the strong expansion that the injected carbon dioxide ($CO_2$) experiences further enhances the increase of pressure.

If the already preheated gas enters the cylinder, this effect is even greater, it has therefore been provided that a heat exchanger is arranged between the carbon dioxide device and the cylinders which, using the exhaust gases, i.e. the residual combustion gases, transmits heat therefrom to the carbon dioxide ($CO_2$) to raise the temperature of the latter.

Carbon dioxide ($CO_2$), currently thrown out in oil and natural gas fields, installations which annually produce millions of tons of said gas and which are currently released directly into the atmosphere, contributing to the level of carbon dioxide present in it, among others, can be used as the raw material for the engine proposed by the invention. This gas, which must be separated from the oil and methane which is the main component of natural gas, can be channeled and conveyed, duly liquefied, to the corresponding distribution centers to finally be used in combustion engines such as the one of the invention, achieving the double advantage of decreasing the consumption of energy and at the same time decreasing atmospheric contamination derived from the combustion of some derivatives of oil, such as diesel and gasoline.

DESCRIPTION OF THE DRAWINGS

To complement the description being made and for the purpose of aiding to better understand the features of the invention according to a preferred practical embodiment thereof, a set of drawings is attached as an integral part of said description, in which, with an illustrative and non-limiting character, the following has been shown.

PREFERRED EMBODIMENT OF THE INVENTION

Figure 1:
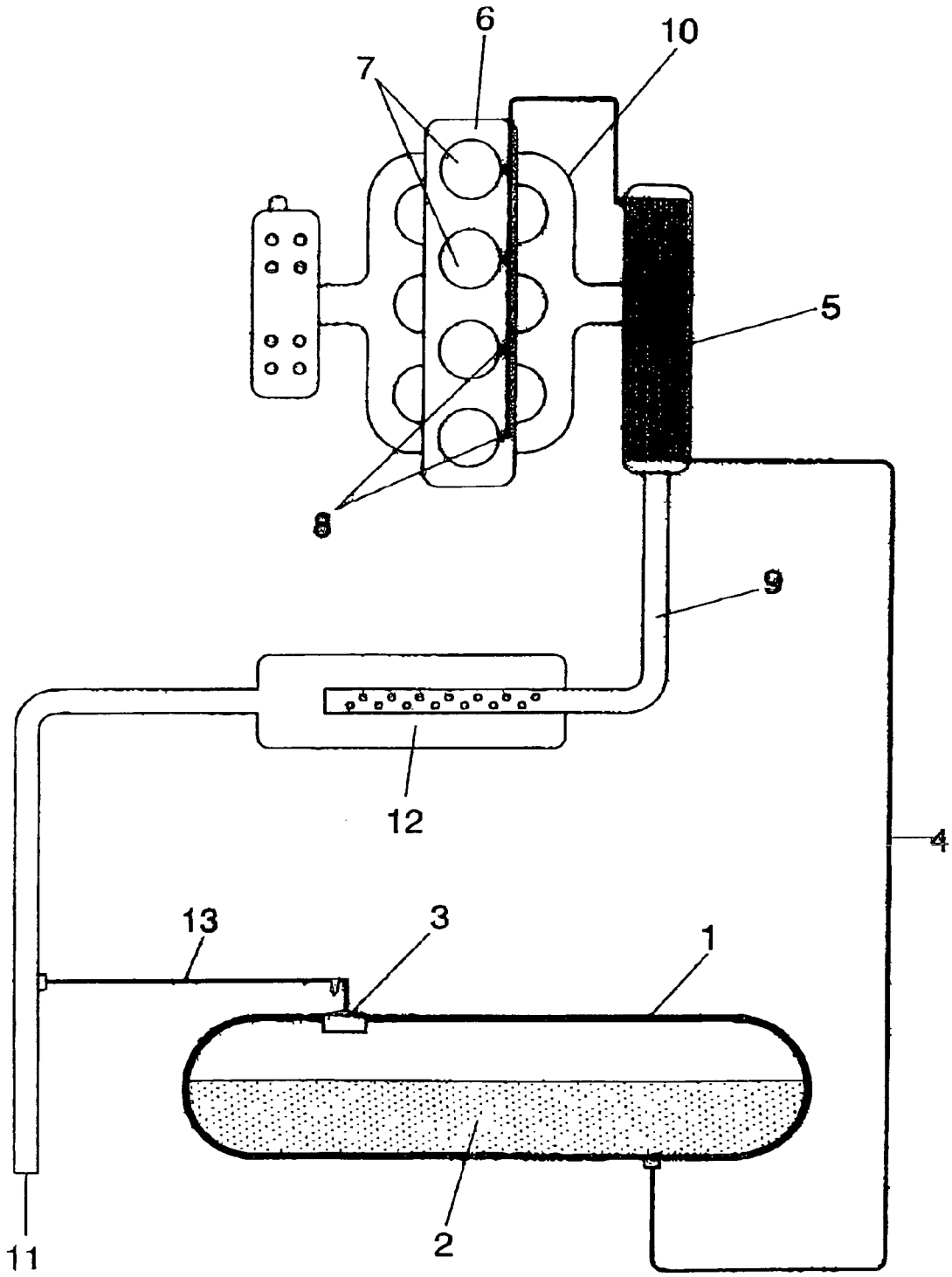
FIG. 1 shows a basic schematic representation of a liquefied carbon dioxide ($CO_2$) installation for supplying a combined-cycle combustion engine carried out according to the object of the present invention, in its specific application to an automotive vehicle.

In view of the indicated figures, particularly FIG. 1, it can be observed how, starting from a combustion engine of any conventional type, i.e. gasoline or diesel engine, the corresponding vehicle is incorporated with a deposit (1) for the carbon dioxide ($CO_2$) (2) in liquid phase, with any suitable capacity, deposit (1) which is aided by a safety valve (3) preventing the pressure inside the deposit from exceeding the maximum level pre-established for that purpose.

A conduit (4) projects from the deposit (1) which, traversing a heat exchanger (5), reaches the engine block (6), and more specifically, each one of the cylinders (7) established therein, through respective injectors (8) schematically depicted in said FIG. 1.

The heat exchanger (5) uses as thermal energy that which is inherent to the combustion gases produced by the engine (6) itself, such that said heat exchanger (5) is in turn inserted in the exhaust pipe (9) which, coming from the exhaust manifold (10), evacuate the combustion gases outside through its terminal outlet (11), after going through the classic muffler (12).

The safety valve (3) will be aided by a conduit (13) also connected to the exhaust pipe (9).

According to this structure, and as previously stated, parallelly to the combustion of the fuel in question, either gasoline or diesel, in each one of the cylinders (7), once the corresponding piston has passed the top dead center, the corresponding injector (8) opens to contribute to said cylinder (7) the pre-established dose of carbon dioxide ($CO_2$), preheated in the heat exchanger (5), such that when the carbon dioxide ($CO_2$) comes into contact with the gases generated in the explosion of the fuel, it experiences a remarkable increase of temperature, which in turn translates into a remarkable expansion, which consequently also increases the pressure existing inside the cylinder (5) itself, and, accordingly, the power generated by the corresponding piston.

Figure 2:
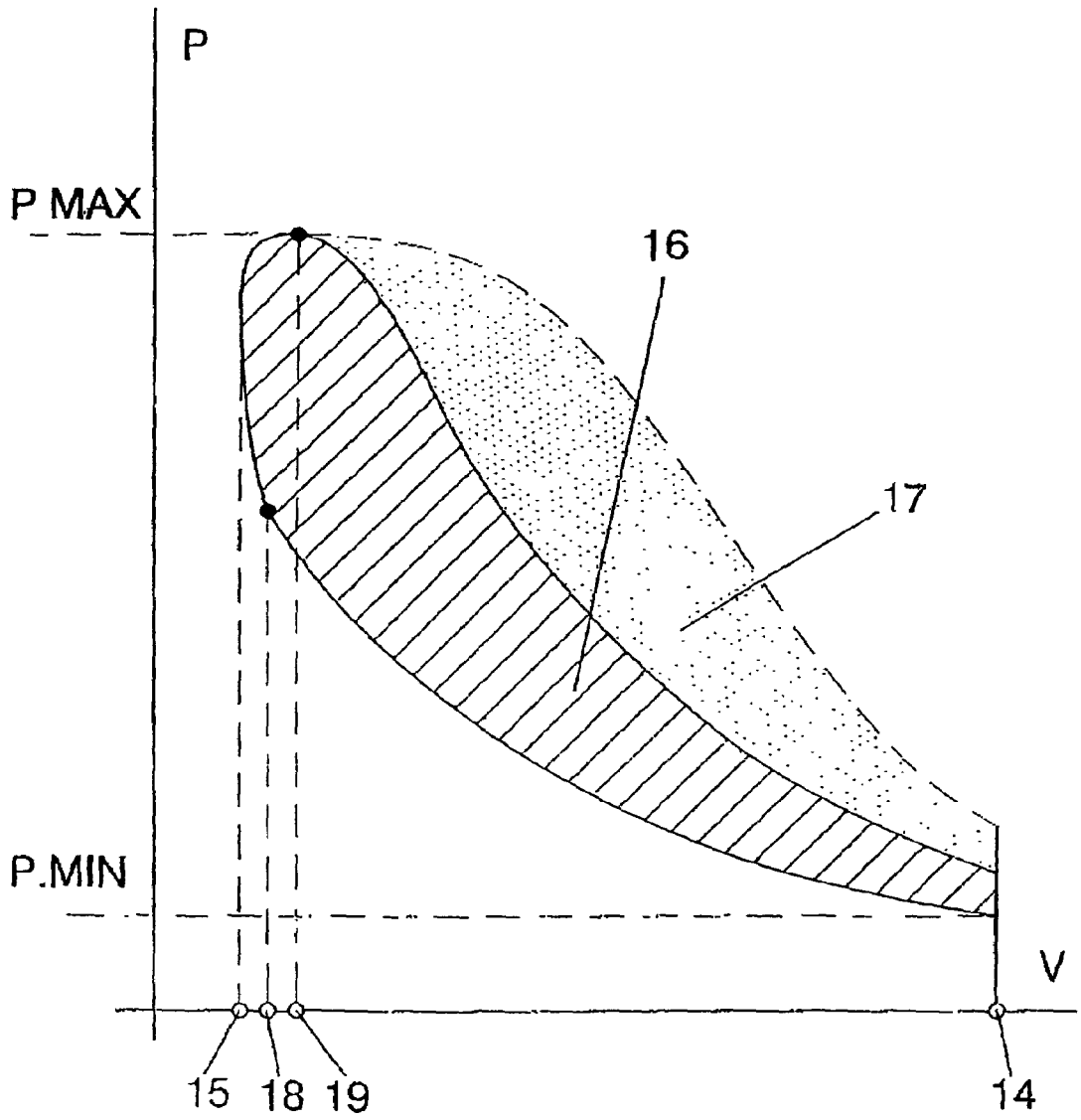
FIG. 2 shows a diagram of the working cycle of the engine of the previous figure.

This effect is graphically observed in the diagram of FIG. 2, corresponding to the working cycle of the engine, in which the volume of the chamber of each cylinder has been depicted on the x-axis, and the pressure on the y-axis, wherein reference number (14) corresponds to the bottom dead center and reference number (15) corresponds to the top dead center, wherein reference number (16) shows the working area carried out by the combustion gases, and reference number (17) shows the supplementary working area carried out by the contribution of carbon dioxide ($CO_2$), wherein reference number (18) shows the point at which the fuel injection (ignition) begins shortly before the piston reaches the top dead center, and where reference number (19) shows the moment in which the carbon dioxide injection begins once the top dead center is passed.

As becomes apparent from observing FIG. 2, the working area (17) due to the incorporation of carbon dioxide ($CO_2$) is a continuation or extension of the working area (16) carried out by the combustion gases, said figure furthermore showing that for the same power of the engine, the invention enables a remarkable fuel consumption decrease, or a heavy engine power increase, without increasing the fuel consumption and without increasing the maximum temperature of the engine, since part of the heat from the combustion gases is absorbed by the carbon dioxide ($CO_2$) during its expansion phase.

A very significant increase of the elasticity of the engine, which would virtually never stop given that the injection for the gas into the cylinders would always keep it in motion within a regimen of minimum revolutions, is parallelly achieved.

A significant increase of the safety in the event of a fire in the vehicle is also produced, given that the carbon dioxide ($CO_2$) (2) existing in the engine supply deposit (1) can be used as a fire extinguishing agent.

If furthermore provides the possibility of starting up the engine even in the event of failure of the electrical start-up system, since simply activating a device enabling the entrance of gas to the inside of the cylinders is enough to start it moving, enabling combustion to be carried out.

It furthermore implies less wear of the engine due to thermal overheating of the parts thereof, especially those corresponding to the exhaust valves and gas collector areas, which translates into an extension of the useful life of the engine.

The production of soot is evidently reduced due to the lack of oxygen for the combustion of the diesel, which is burned inside the engine, given that since less fuel is burned and is burned in better conditions with the same amount of air in the case of the diesel engine, the formation of soot is reduced and the lubricating oil becomes less dirty, which enables changing the oil less frequently.

Furthermore, a vehicle provided with this type of engine could work better in difficult atmospheric conditions, such as those existing in high mountain passes, where lower atmospheric pressure translates into a lack of power and into overheating of the engine.

It furthermore provides the possibility of keeping the engine running in enclosed areas, supplied only with carbon dioxide ($CO_2$) at a very low revolution idling, completely eliminating the risk of carbon monoxide blood poisoning.

The invention claimed is:

1. A combined-cycle combustion engine based on a contribution of pre-heated carbon dioxide ($CO_2$) to combustion gases, the engine incorporating a basic structure equivalent to that of a conventional gasoline or diesel combustion engine, wherein a conduit operable to supply carbon dioxide ($CO_2$) from a carbon dioxide ($CO_2$) storage tank traverses a heat exchanger for pre-heating carbon dioxide ($CO_2$) prior to injection into an engine cylinder, and each cylinder of said engine incorporates an injector for carbon dioxide ($CO_2$) coming from the carbon dioxide $CO_2$ storage tank supplying said pre-heated carbon dioxide ($CO_2$) such that immediately after fuel explodes in the cylinder, a strong thermal expansion of the carbon dioxide ($CO_2$) occurs, translating into an increase of torque, and each injector is operable to supply the pre-heated carbon dioxide ($CO_2$) to the corresponding cylinder near an inner surface of said cylinder, such that the carbon dioxide ($CO_2$) generates a perimetral barrier for the combustion gases for absorbing a substantial portion of heat for thermal expansion of the carbon dioxide and for reducing the thermal level in the engine block.

2. A combined-cycle combustion engine based on the contribution of pre-heated carbon dioxide ($CO_2$) to the combustion gases according to claim 1, wherein the injectors (8) for the pre-heated carbon dioxide ($CO_2$) are controlled such that the opening the injectors and, accordingly, the entry of carbon dioxide in each cylinder, occurs after a piston in the cylinder has passed a top dead center, and immediately after the combustion of the injected fuel has occurred in the cylinder (7).

3. A combined-cycle combustion engine based on a contribution of pre-heated carbon dioxide ($CO_2$) to the combustion gases, the engine incorporating a basic structure equivalent to that of a conventional gasoline or diesel combustion engine, and each cylinder of said engine having incorporated an injector for carbon dioxide ($CO_2$) coming from a tank supplying said pre-heated carbon dioxide ($CO_2$), such that immediately after fuel explodes in the cylinder, a strong thermal expansion of the carbon dioxide ($CO_2$) occurs, translating into an increase of torque, a heat exchanger arranged in the conduit feeding the carbon dioxide ($CO_2$) to the cylinders from the tank supplying said carbon dioxide ($CO_2$), and operable for increasing the temperature of the carbon dioxide ($CO_2$) existing in said tank prior to the access of the carbon dioxide ($CO_2$) to the cylinders, said heat exchanger being inserted in an exhaust pipe on which an exhaust manifold and the engine converge.

4. A combined-cycle combustion engine based on the contribution of pre-heated carbon dioxide ($CO_2$) to the combustion gases, the engine incorporating a basic structure equivalent to that of a conventional gasoline or diesel combustion engine, wherein a conduit operable to supply carbon dioxide ($CO_2$) from a carbon dioxide ($CO_2$) storage tank traverses a heat exchanger for pre-heating carbon dioxide ($CO_2$) prior to injection into an engine cylinder, and each cylinder of said engine incorporates an injector for carbon dioxide ($CO_2$) coming from a tank supplying said pre-heated carbon dioxide ($CO_2$) such that immediately after fuel explodes a strong thermal expansion of the carbon dioxide ($CO_2$) occurs, translating into an increase of torque, further wherein the tank containing the carbon dioxide ($CO_2$) incorporates a safety valve connected by a conduit with an exhaust pipe of the engine, the safety valve limiting the maximum pressure inside said tank.

5. The combined-cycle combustion engine based on the contribution of pre-heated carbon dioxide ($CO_2$) to the combustion gases according to claim 1, wherein the engine is operable at a low engine revolution idling with no fuel and only with supply of additional carbon dioxide ($CO_2$).

* * * * *